US006651682B1

(12) United States Patent
Woodward

(10) Patent No.: US 6,651,682 B1
(45) Date of Patent: Nov. 25, 2003

(54) RUGGED ASSEMABLE, DISASSEMABLE AND STORABLE UMBRELLA

(76) Inventor: James Woodward, 933 N. Easley Canyon Rd., Glendora, CA (US) 91741-2215

( * ) Notice: Subject to any disclaimer, the term of this patent is extended or adjusted under 35 U.S.C. 154(b) by 69 days.

(21) Appl. No.: 09/922,343

(22) Filed: Aug. 3, 2001

(51) Int. Cl.[7] ..... A45B 25/10

(52) U.S. Cl. ..... 135/28; 135/34.2; 135/909; 224/915

(58) Field of Search ..... 135/28, 29, 30, 135/34.2, 909; 224/915; 403/170, 172, 218

(56) References Cited

U.S. PATENT DOCUMENTS 899,718 A * 9/1908 Eberle ..... 135/30
3,181,542 A * 5/1965 Bareis ..... 135/98
4,627,210 A * 12/1986 Beaulieu ..... 52/646
4,637,748 A * 1/1987 Beavers ..... 403/170
4,750,509 A * 6/1988 Kim ..... 135/135
5,494,064 A * 2/1996 Chuang Lee ..... 135/28
6,296,415 B1 * 10/2001 Johnson et al. ..... 403/170
6,298,867 B1 * 10/2001 Chang ..... 135/28

* cited by examiner

*Primary Examiner*—Robert Canfield
(74) *Attorney, Agent, or Firm*—Daniel L. Dawes; Myers Dawes Andras & Sherman LLP

(57) ABSTRACT

An umbrella frame includes a hub, a center pole coupled to the hub for supporting the hub, and a plurality of ribs disposable into the hub. The ribs serve to extend, stretch or support the cover. The hub has a corresponding plurality of pairs of bores defined therein. One of the bores of each pair is used for deploying the ribs in a configuration to support the cover and the other for storing the ribs. One of the bores of the pair is inclined relative to a horizontal plane defined by the hub, and the other is vertical to a horizontal plane. Each rib has an end disposable into the hub and a spring lock to selectively lock into the hub. The pair of bores coact with the spring lock to selectively lock the rib in the bores in both the deployment and storage configurations.

20 Claims, 5 Drawing Sheets

RUGGED ASSEMABLE, DISASSEMABLE AND STORABLE UMBRELLA

BACKGROUND OF THE INVENTION

1. Field of the Invention

The invention relates to the field of umbrellas and in particular to umbrellas that can be assembled, disassembled and stored.

2. Description of the Prior Art

Kim, "Folding Device of a Tent-Framework," U.S. Pat. No. 4,750,509 (1988) shows in FIGS. 1 and 2, a joint plate 5 formed at the center of a central hub member 1. A plurality of U-shaped concave openings 7 are formed in the periphery of the joint plate 5 and spaced radially around the joint plate, for receiving the ends of ribs or framework pieces 3. Each opening 7 has a joint groove 9 located on each of the sidewalls of the opening, which are substantially perpendicular to the outer periphery of the joint plate 5. Each joint groove 9 is further provided with two hanging jaw devices 8 located across from one another on the walls of the joint groove 9. A plurality of approximately half round rib grooves 6 are spaced radially about the periphery of the disk or hub member 1 and located adjacent to each opening 7. Preferably, six of these openings and rib grooves are provided around the periphery of the hub member 1, for receiving six radially extending ribs 3, as indicated.

Beaulieu, "Hub Assembly For A Collapsible Structure," U.S. Pat. No. 4,627,210 (1986) shows in FIGS. 5 and 6, circular hub body 20 with a central opening 22 which forms inner wall 24. Preferably, eight retaining slots or sockets 30, each preferably being circular in cross-section, extend radially inward through the thickness of hub body 20. Shoulders or collars 32 are located approximately near the middle of each retaining slot 30's length. The spherical heads 14 of extension caps 12 fit within retaining slots or sockets 30 while shoulders 32 provide seats to prevent heads 14 from passing therethrough, analogous to a ball-and-socket relationship.

Lucas, "Umbrella," U.S. Pat. No. 2,306,706 (1941) shows in FIGS. 6 and 7, a rib holder is mounted upon post 11, this holder comprising a notched hub 33, a notched retaining disk 34, and a retaining ring 35. One end of the hub is reduced in size and the ring is placed upon this reduced end and in a groove that is closed on one side by the disk 34, as shown in the Figures. The ribs 16 have loops 36 with elongated openings 24 within which the retaining ring 35 is engaged, gaps 37 into the elongated openings 24 being provided to receive the edge of the rib support when the ribs are turned to their lowered positions.

Zeigler, "Hub Assembly For Collapsible Structures," U.S. Pat. No. 4,280,521 (1981) shows in FIG. 3, the two hub bodies 9 and 10 are of similar configuration. The body 9 is of disk-like form provided with a central opening 11 and with a series of radial slots 12. The face 13 of the body 9 is provided with the circular recess 14 which is so located that it intersects the slots 12 adjacent to but spaced outwardly from their inner ends 15. The body 10 is similarly formed with the central opening 11', radial slots 12', and circular recess 14, in its face 13'. As shown in FIG. 2, these two bodies are assembled in face-to-face relation with the openings 11, 11', slots 12, 12', and recesses 14, 14' in registry.

Prusmack, "An Articulating Hub Assembly," U.S. Pat. No. 5,797,695 (1998) shows in the Figures, a tang 14 having a head 15 and a tail 16 is inserted into each of the radial slots 3 and 8. Tang 14 is held in place by a roll pin 17 which is inserted through an opening 18 through head 15 and is secured in groove 3A. As shown in FIG. 1, hub body 1 is a disk-like unit having a central opening 2 therethrough and a series of radial slots 3 extending inwardly from the periphery of disk 1 and having a series of openings 4 extending through disk 1 and positioned radially between each of the radial slots 3 and between periphery 5 and central opening 2. A groove 3A is located perpendicular to each of radial slots 3.

What is needed is a simple, robust hub and rib combination for use as an umbrella in which the hub is integral and provides rigid, captured structural support for each rib, provides for the possibility of individual rib replacement, and provides for storage using the hub as the storage fixture.

BRIEF SUMMARY OF THE INVENTION

The invention is an umbrella frame for supporting a cover comprising a hub, a center pole coupled to the hub for supporting the hub in a vertical position, and a plurality of ribs disposable into the hub. The ribs serve to extend, stretch or support the cover. The hub has a corresponding plurality of bores defined therein to receive the ribs. The bores are paired with each other as corresponding first and second sets. The first set of the bores are used for deploying the ribs in a configuration to support the cover. The second set of the bores are used to provide a storage configuration of the ribs. The umbrella frame can be considered as being combined with the cover to provide an umbrella assembly.

The first set of bores are inclined relative to a horizontal plane defined by the hub. The second set of bores are defined to be vertical relative to a horizontal plane defined by the hub.

Each rib has an inner end which is disposable into the hub and a spring lock to selectively retain the rib in the hub. The second set of bores coact with the spring lock to selectively lock the rib in the first set of bores. The first set of bores coact with the spring lock to selectively lock the rib in the second set of bores.

The ribs and center pole are telescopic and locking so that their length can be adjusted. The cover has a center grommet and the center pole has a pin. The pin is disposable in the grommet when the cover is deployed on the ribs. Thus the tension on the cover is adjustable.

In the illustrated embodiment the hub includes a corresponding plurality of integral fixture blocks, each block having one bore from each of the first and second sets defined therein. In very general terms, when the hub has n-fold symmetry and n ribs are disposable therein, a selected number, j, of the n ribs can selectively be disposed in the hub, where j=n or less, and preferably some submultiple, i.e. j=4 if n=8, 3 if n=6, 3 if n=9 and so forth to result in a symmetrical array of ribs, even at the submultiple number. Thus, an octagonal or square cover can be set on an octagonal hub, a hexagonal or triangular cover can be set on a hexagonal hub and so forth.

The umbrella assembly thus has the versatility that the cover deployed on one and the same umbrella frame can be any one of a plurality of selectable sizes, shapes or motifs, i.e. colors or graphically decorated.

On the top of the central hub is a universal mounting stub at the top end of the telescopic center pole. This stub allows a variety of finials to be firmaly secured to the umbrella. Custom or corporate logo flags may be used in lieu of typical finials.

A pair of storage plates having an array of mounting means defined therein for engaging the center pole at its opposing ends can be used to store a plurality of the umbrella frames into an array of frames. In the embodiment where the mounting means is an array of holes, the plurality of the umbrella frames are stored in an alternating array of upright and inverted umbrella frames.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

An umbrella frame includes a hub, a center pole coupled to the hub for supporting the hub, and a plurality of ribs disposable into the hub. The ribs serve to extend, stretch or support the cover. The hub has a corresponding plurality of pairs of bores defined therein. One of the bores of each pair is used for deploying the ribs in a configuration to support the cover and the other for storing the ribs. One of the bores of the pair is inclined relative to a horizontal plane defined by the hub, and the other is vertical to a horizontal plane. Each rib has an end disposable into the hub and a spring lock to selectively lock into the hub. The pair of bores coact with the spring lock to selectively lock the rib in the bores in both the deployment and storage configurations.

Figure 1:
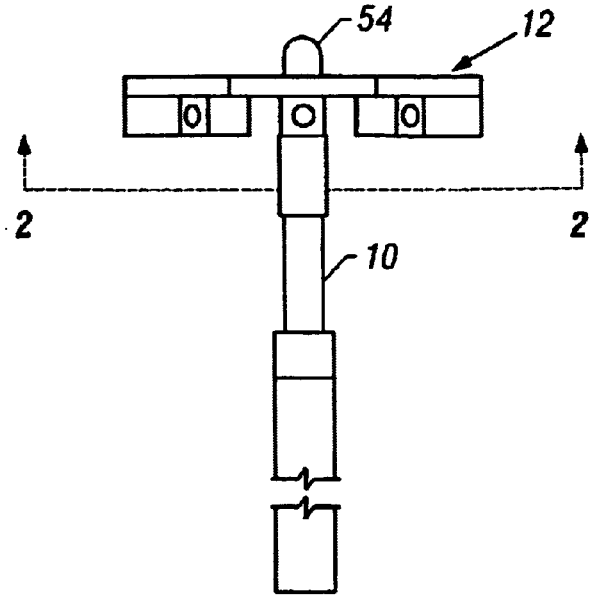
FIG. 1 is side elevational view of the center pole and hub of the umbrella.
Figure 2:
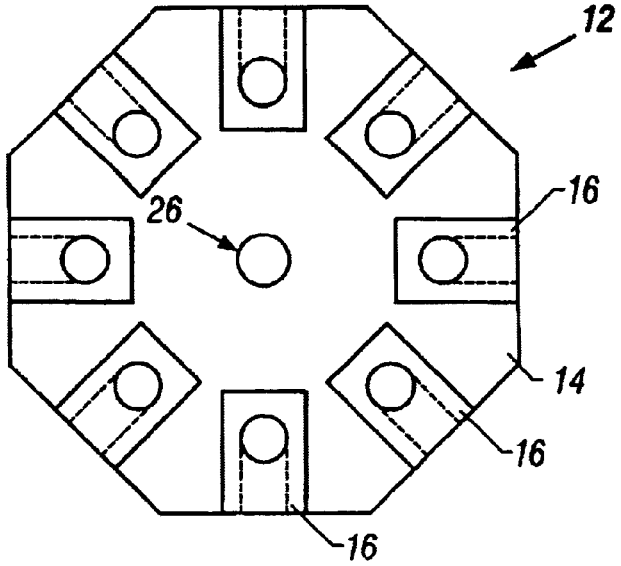
FIG. 2 is a plan elevational view of the hub as seen through sectional lines 2—2 of FIG. 1.

FIG. 1 is a side elevational view of a telescopic and locking center pole 10 fitted with a top hub generally denoted by reference numeral 12. FIG. 2 is a plan view of hub 12 as seen through sectional lines 2—2 of FIG. 1 which shows an octagonal metal plate 14 with a plurality of pole fixtures 16 attached thereto. In the illustrated embodiment plate 12 is octagonal and has eight fixtures 16 affixed by welding or other means to plate 12. It is to be understood that hub 12 may have other symmetries if desired, for example, triangular, square, rectangular, pentagonal, hexagonal, heptagonal, and any other regular or irregular polygonal shape can be equivalently substituted for the octagonal hub 12 shown. A plurality of telescopic ribs 24 can be locked in hub 12 in a deployed configuration as shown in the perspective view of FIG. 4. Both ribs 24 and center pole 10 are telescopic locking Fiberglass tubes, which are conventionally telescopic and lockable according to any telescopic and lockable mechanism now known or later devised, including but not limited to the mechanism shown in U.S. Pat. No. 5,549,407. Thus, it is one of the advantages of the invention that the length of ribs 24 can be arbitrarily fixed when the umbrella is assembled or erected to accommodate a variety of covers 36 as will be more fully described in connection with FIGS. 6*a* and 6*b*.

Figure 3:
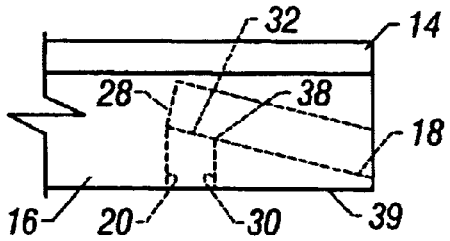
FIG. 3 is a side elevational enlarged view of one of the rib fixtures shown attached to the hub plate which is shown in partial side cross-sectional cutaway view.
Figure 9A:
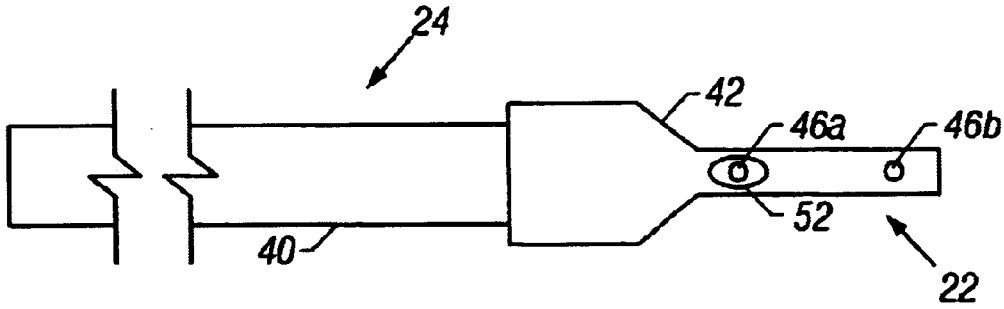
FIG. 9*a* is a side elevational enlarged view of a rib.
Figure 9B:
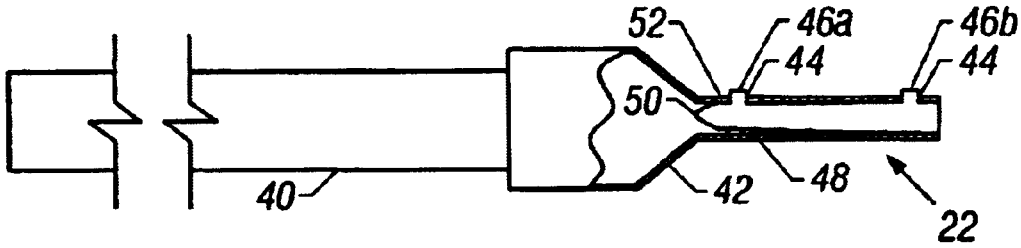
FIG. 9*b* is a side elevational enlarged view of a rib rotated 90° relative to the view shown in FIG. 9*a*.

A fixture 16 is mounted on or affixed to plate 12 at the center of each face or segment of hub 12. Fixture 16 as shown in enlarged side view of FIG. 3 is a metallic or solid block with an angled rib bore 18 defined therein as shown in dotted outline for receiving the inner end 22 of telescopic radial ribs 24 as best depicted in FIGS. 9*a* and 9*b*. Bore 18 has a diameter which provides a clearance fit for inner end 22 of telescopic radial rib 24 and is angled downwardly from the center 26 of plate 14. The angle of inclination is exaggerated in FIG. 3, and may be arbitrarily chosen to shed rain and other settling debris, but in the illustrated embodiment an angle of 13 to 15 degrees is preferred.

Figure 5:
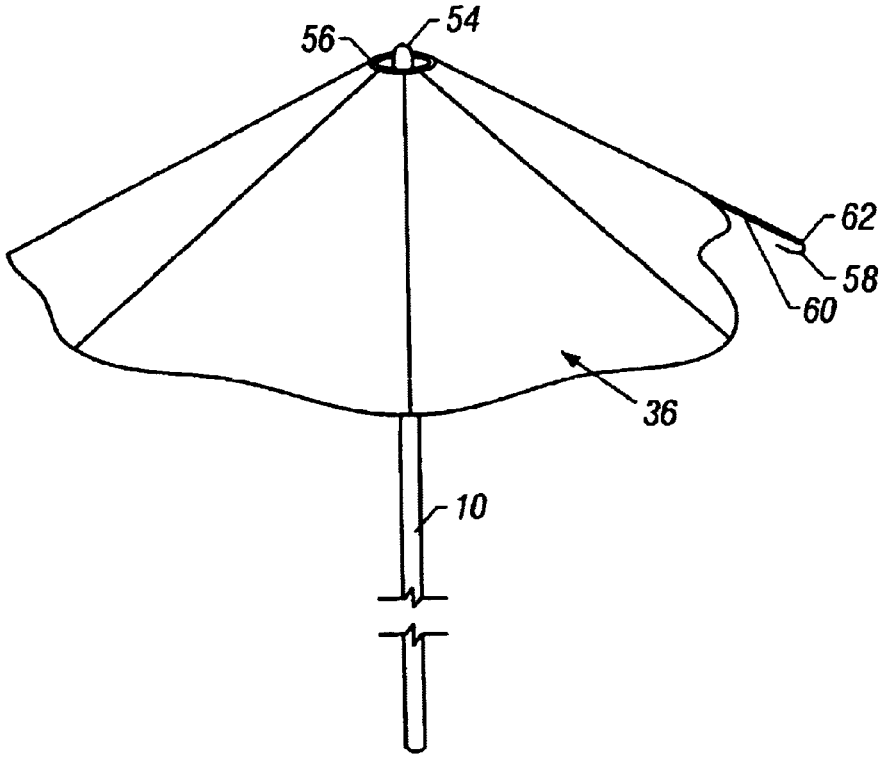
FIG. 5 is a side perspective of the umbrella with the cover installed.
Figure 8:
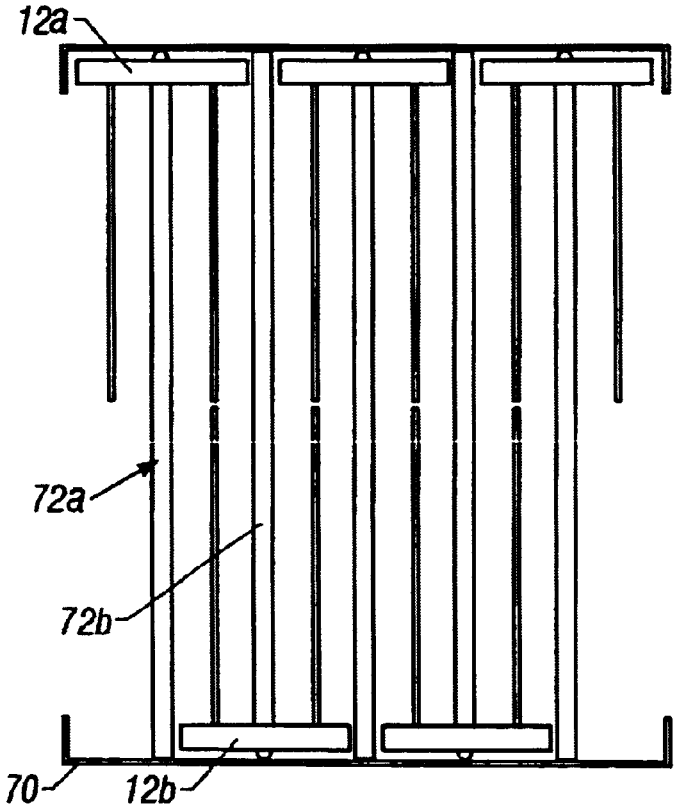
FIG. 8 is a side diagrammatic view of a plurality of umbrellas configured in the stored configuration and retained by two opposing storage plates.

At the inner end 28 of bore 18 a vertical bore 20 is defined having an opening aperture 30 on lower surface 34 and an upper end 32 which coincides with and merges with inner end 28 of bore 18. Bore 20 also has a diameter which provides a clearance fit for inner end 22 of telescopic radial rib 24. Bore 18 thus provides a supporting fixture portion for rib 24 when rib 24 is deployed to carry umbrella cover 36 as shown in FIG. 5. Bore 20 provides a storage support for rib 24 when the umbrella is disassembled into its storage configuration. In addition edge 38 defined by the junction of bores 18 and 20 provide a locking edge for rib 24 for both the assembled configuration for supporting cover 36 as shown in FIG. 5 and for retaining ribs 24 in the storage configuration as shown in FIG. 8.

How locking is provided by edge 38 inside bores 18 and 20 can be understood in the context of FIGS. 9*a* and 9*b*. FIG. 9*a* shows inner end 22 of rib 24. In the illustrated embodiment end 22 is provided with a metal fitting 42 coupled to the Fiberglass telescopic rod 40. Fitting 42, which is riveted to the end of rod 40 and which provides inner end 22 of rib 24, has two aligned holes 44, defined therethrough. A resilient J-shaped leaf spring 48 is disposed in the hollow body of fitting 42 as best depicted in the cutaway view of FIG. 9*b*. Spring 48 as two aligned buttons 46*a* and 46*b* defined therein which are configured to extend through holes 44 in fitting 42. Resilient J-shaped leaf spring 48 is oriented in fitting 42 so that a hinge portion 50 is distal from the extreme terminus of end 22. When the proximal button 46*a* is manually pressed into fitting 42, distal button 46 bis drawn downward into fitting 42 and completely clears the outer surface of end 22, even if proximal button 46*a* has not. An elliptical depression 52 can be defined in the proximity of proximal button 46*a*, if desired to facilitate its manual depression into fitting 42 and hence the complete withdrawal of distal button 46*b* into fitting 42.

Figure 9C:
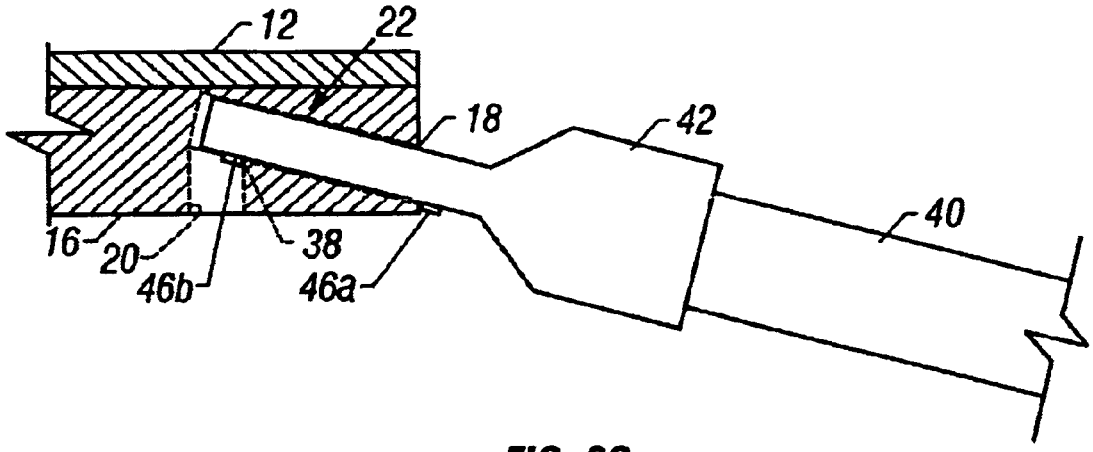
FIG. 9*c* is a side cross-sectional view of the inner end of the rib shown in a locked position in the deployed configuration in the hub fixture.

When end 22 is disposed in bore 18 as shown in FIG. 9*c*, proximal button 46*a* is pressed to permit clearance of distal button 46*b* into bore 18. Proximal button 46*a* is then released and end 22 is disposed upward into bore 18 until distal button 46*b* clears edge 38 and distal button 46*b* pops out into a locking configuration. At this time proximal button is positioned and at all time remains positioned outside of bore 18. The length of end 22 and the depth of bore 18 prevents fitting 42 from being disposed so deeply within bore 18 that there is a substantial danger of proximal button 46*a* being impacted or depressed. Even if proximal button 46*a* were to abut fixture 16, proximal button 46*a* would normally prevent further insertion of end 22 into bore 18. With distal button 46*b* popped out over edge 38 and extending into bore 20, rib 24 is securely locked into place in bore 18 and will not slide out. The locking of distal button 46*b* into bore 18 also prevents removal rib 24 from bore 20.

When it is desired to remove rib 24, proximal button 46*a* is again depressed, distal button 46*b* is withdrawn into fitting 42 and clears edge 38 and bore 20. Rib 24 can then be easily slid out of bore 18. By an exactly analogous operation end 22 can be inserted and locked into bore 20 using bore 18 as the locking bore. Rib 24 can then be vertically hung from hub 12 and retained in a locked compact storage position with center pole 10 and the remaining ribs 24 as shown in FIG. 8.

Rotating rib 24 in bore 18 or 20 and advancing rib 24 slightly into the bore also allows distal button 46*b* to ride up and out of the locking bore, i.e. if rib is in bore 18 and locked into bore 20, rotating it and simultaneously pushing it into bore 18 allows button to move off of edge 38 and to be depressed as it rides onto the interior surface of bore 18. By this simultaneous motion of rotation and insertion into its bore, distal button 46*b* is shoe-horned out of the locking bore and into the insertion bore, thereby depressing it and allowing it to be removed, provided it remains in a position where it is rotated out of alignment with the locking bore. This allows for quick and easy removal, but does not in any manner jeopardize the security of attachment since ribs 24 are normally not subjected to any rotational force and a very definite and positive degree of rotation exceeding any small accidental rotation is needed to rotate distal button 46*b* out of the locking bore.

Figure 4:
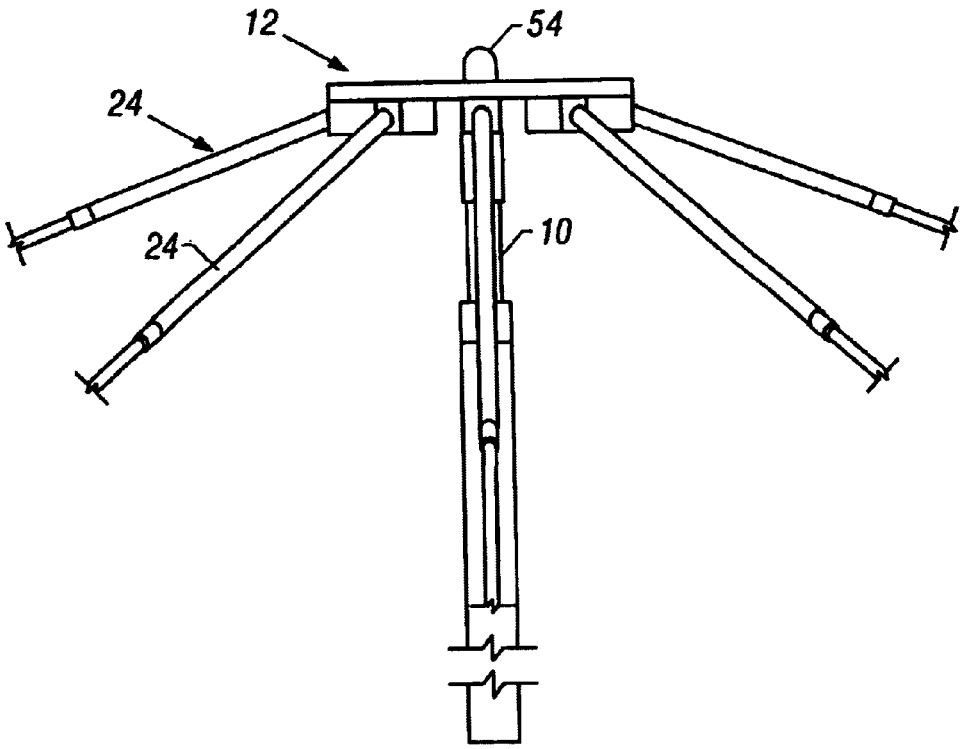
FIG. 4 is a side perspective of the center pole, hub and ribs shown in an assembled configuration.

After radially extending telescopic and locking ribs 24 shown in FIG. 4 have been slid into bores 18 with a spring loaded button 46*b* locking into bore 20 to form a conventionally shaped umbrella frame as shown in FIG. 4, a conventional fabric umbrella cover 36 with a metallic or hard center grommet 56 is slide over center pole pin 54. By this grommet and pin combination cover 36 is centered and anchored on the umbrella frame. Radial fabric, leather or plastic pockets 58 attached to the underside of edges 60 of cover 36 provide a snug fit for outer ends 62 of ribs 24 as shown in the cutaway side cross-sectional view of FIG. 5. Ends 62 may be smoothed or provided with a smooth termination. Ribs 24 are telescopically adjusted and locked into a fixed length to apply the appropriate amount of tension along each rib 24 between center grommet 56 and pocket 58 on edge 60, thereby providing a radially taut, smooth deployment of covering 36.

Figure 6A:
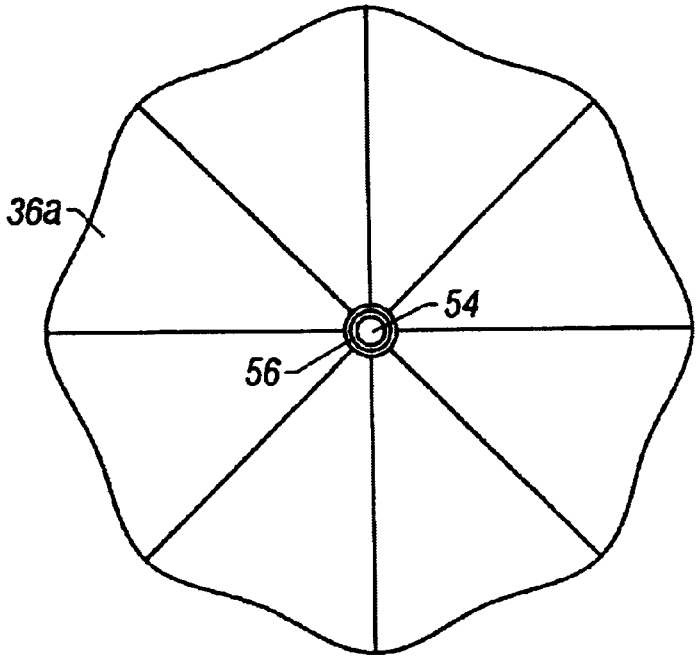
FIG. 6*a* is a top plan view of the umbrella with an octagonal cover installed.
Figure 6B:
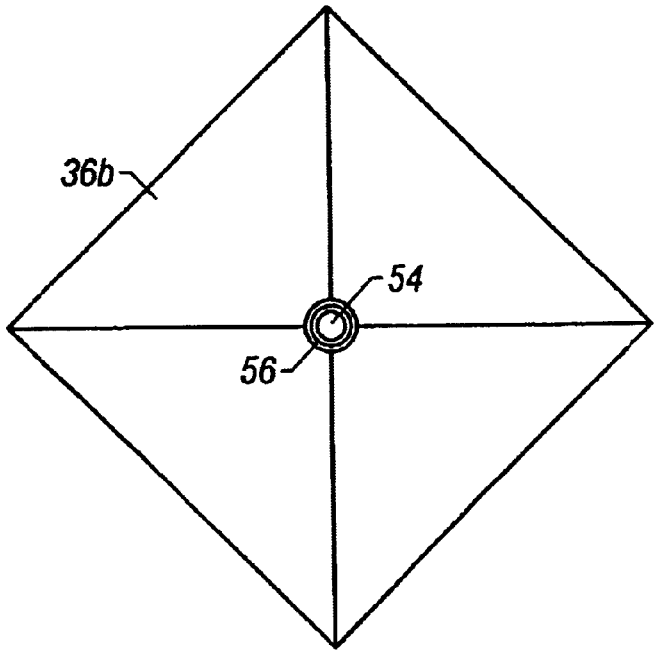
FIG. 6*b* is a top plan view of the umbrella with a square cover installed.

FIGS. 6*a* and 6*b* shown top plan views of a deployed cover 36*a* and 36*b* respectively. The embodiment of FIG. 6*a* is an octagonal cover 36*a*. The same frame can also support a square cover 36*b* by omitting every other rib 24. A hexagonal hub 12 can similarly support triangular or hexagonal cover. Hubs of different symmetries can clearly support covers of compatible symmetries according to the teachings of the invention.

It should also be clear that the same frame configuration can support different size covers 36 according to the shortening or lengthening of ribs 24 as well as different shaped covers 36.

Still further any frame configuration can be easily provided with multiple interchangeable covers 36 since cover 36 is not permanently fixed to ribs 24 or pin 54. Covers 36 can thus be changed according to the season and event, using for example different covers 36 for rental umbrellas at events sponsored by different sponsors, or changing covers 36 at an outdoor restaurant according to the local season or festival.

Figure 7:
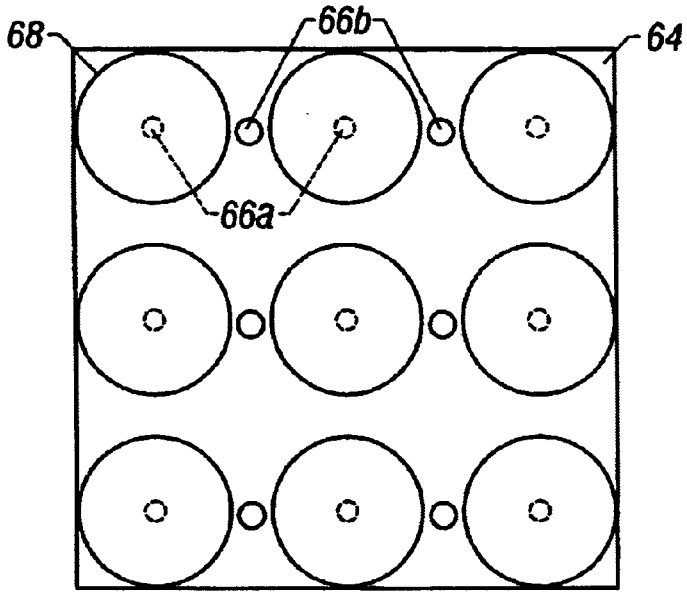
FIG. 7 is a top plan view of one of two storage plates.

When the umbrella is to be stored, then the assembly is taken apart, fabric cover 36 is taken off, and ribs 24 are disposed through bores 20 to be retained in a vertical storage position as shown in FIG. 8. In this configuration button 46*b* then locks into bore 18. A pair of storage plates 64 can be used to advantage for this purpose as shown in FIGS. 7 and 8. Plate 64 may be as simple as a flat metal plate having a plurality of holes 66*a* and 66*b* defined therein. Holes 66*a* and 66*b* may have the same diameter or be differently sized. Holes 66*a* for example are provided for receiving pin 54 of center pole 10. The terminal portion of pin 54 may be slightly crowned or tapered so that a snug temporary press fit is obtained when pin 54 is inserted into hole 66*a*. Circle 68 in FIG. 7 represents the envelope in which hub 12 is then positioned. Center pole 10 then extend perpendicularly to plate 64 to an identical opposing plate 64. The lower end 70 of center pole 10 then fits into an opposing hole 66*a* in the opposing plate 64. Ribs 24 are telescoped to their minimal length and extend vertically along side of center pole 10.

A first umbrella frame assembly 72*a* is thus positioned between two opposing plates. A second umbrella frame assembly 72*b* is similarly positioned in an inverted configuration next to first umbrella frame assembly 72*a* with its end 70 disposed and its pin 54 disposed into holes 66*b* in the opposing plates 64. Thus, holes 66*a* retain the upright frames assemblies 72*a* and holes 66*b* retain the inverted frames assemblies 72*b*. In this manner two plates 64 as shown in FIG. 7 can provide a storage rack for 15 umbrella frame assemblies 72. The number and exact array for such storage can be varied arbitrarily according to the teachings of the invention. In this manner, a plurality of umbrella frame assemblies 72 can be transported and handled from site to site.

The advantage of the umbrella is that it is more rugged and can be used in the rental market where shipping, handling and misuse frequently damage conventional designs of umbrellas to either limit their useful life or to result in ongoing repair costs. Heavy walled, impact resistant Fiberglass tubing can be used for ribs 24 and pole 10 making them virtually indestructible. Cover 36 can be made of heavy rip-resistant fabric. Hub 12 is made out of heavy duty machined aluminum or steel. Hub 12 could be made out of a single machined block or metal, or molded in any number of forms to provide a rigid integral structure. It should be clear that hub 12 can take a myriad of outward physical forms or include lightening holes and reinforcing webs of any design without departing from the spirit and scope of the invention.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. An umbrella frame for supporting a cover comprising:

a hub;

a center pole coupled to said hub for supporting said hub in a vertical position; and a plurality of ribs disposable into said hub, wherein said ribs extend said cover, and where said hub has a corresponding plurality of bores defined therein to receive said ribs, said bores being paired with each other as corresponding first and second sets, said first set of said bores for deploying said ribs in a configuration to support said cover, and said second set of said bores for providing a storage configuration of said ribs.

2. The umbrella frame of claim 1 further comprising said cover to provide an umbrella assembly.

3. The umbrella frame of claim 1 wherein said first set of bores are inclined relative to a horizontal plane defined by said hub.

4. The umbrella frame of claim 1 wherein said second set of bores are vertical relative to a horizontal plane defined by said hub.

5. The umbrella frame of claim 3 wherein said second set of bores are vertical relative to a horizontal plane defined by said hub.

6. The umbrella frame of claim 1 wherein each said rib has an inner end disposable into said hub and a spring lock to selectively retain said rib in said hub.

7. The umbrella frame of claim 6 where said second set of bores coact with said spring lock to selectively lock said rib in said first set of bores.

8. The umbrella frame of claim 6 where said first set of bores coact with said spring lock to selectively lock said rib in said second set of bores.

9. The umbrella frame of claim 6 where said first and second set of bores coact with said spring lock to selectively lock said rib in each other set of bores.

10. The umbrella frame of claim 1 wherein said ribs are telescopic and locking so that their length can be adjusted.

11. The umbrella frame of claim 10 wherein said center pole is telescopic and locking so that its length can be adjusted.

12. The umbrella assembly of claim 2 wherein said cover has a center grommet and said center pole has a pin, said pin being disposable in said grommet when said cover is deployed on said ribs.

13. The umbrella assembly of claim 12 wherein said ribs are telescopic and locking so that their length can be adjusted, and tension on said cover adjusted.

14. The umbrella frame of claim 1 where said hub includes a corresponding plurality of integral fixture blocks, each block having one bore from each of said first and second sets defined therein.

15. The umbrella assembly of claim 2 wherein said hub has n-fold symmetry and n ribs disposable therein, a selected number, j, of said n ribs being disposed in said hub, where j=n or less.

16. The umbrella assembly of claim 2 where said ribs are telescopic and lockable and where said cover is characterized by being one of a plurality of selectable sizes.

17. The umbrella assembly of claim 2 where said cover is characterized by being one of a plurality of selectable shapes.

18. The umbrella assembly of claim 2 where said cover is characterized by being one of a plurality of selectable motifs.

19. The umbrella frame of claim 1 further comprising a plurality of said umbrella frames and a pair of storage plates having an array of mounting means defined therein for engaging said center pole at opposing ends to store said plurality of said umbrella frames into an array of frames.

20. The umbrella frames of claim 19 where said mounting means is an array of holes and said plurality of said umbrella frames are stored in an alternating array of upright and inverted umbrella frames.

* * * * *